US006418998B1

(12) United States Patent
Tuoriniemi

(10) Patent No.: US 6,418,998 B1
(45) Date of Patent: Jul. 16, 2002

(54) TAPE APPLICATOR

(76) Inventor: Veijo M. Tuoriniemi, 210 E. 17th St. apt. 4-D, New York, NY (US) 10003

( * ) Notice: Subject to any disclaimer, the term of this patent is extended or adjusted under 35 U.S.C. 154(b) by 0 days.

(21) Appl. No.: 09/459,657

(22) Filed: Dec. 13, 1999

Related U.S. Application Data

(60) Provisional application No. 60/111,969, filed on Dec. 11, 1998.

(51) Int. Cl.[7] ..... B32B 31/00
(52) U.S. Cl. ..... 156/577; 156/579
(58) Field of Search ..... 156/574, 577, 156/579

(56) References Cited

U.S. PATENT DOCUMENTS 5,174,850 A * 12/1992 Stefan ..... 156/324
5,468,332 A * 11/1995 Dretzka et al. ..... 156/527
5,672,238 A * 9/1997 Samuelson ..... 156/579
5,698,067 A * 12/1997 Packard ..... 156/577
5,788,807 A * 8/1998 Gratz ..... 156/577
5,792,310 A * 8/1998 Thompson et al. ..... 156/523
5,921,450 A * 7/1999 Robinson ..... 156/579 X

* cited by examiner

*Primary Examiner*—Mark A. Osele
(74) *Attorney, Agent, or Firm*—Charles E. Bruzga

(57) ABSTRACT

A tape applicator suitable for applying a tape having a pressure sensitive adhesive layer facing outside of the center of a tape roll having an inner core and an outer core. The inner core is rotably mounted inside of an outer core. The inner core has an handle to hold the applicator in hand. The tape applicator is secured inside of a core of a tape roll.

1 Claim, 1 Drawing Sheet

TAPE APPLICATOR

CROSS REFERENCE TO RELATED APPLICATIONS

This invention improves on provisional application "Masking Tape", filed 12/31/1997 and provisional application "Tape", serial number 60/109,114 filed 11/18/1998.

This application claims benefit of provisional application Ser. No. 60/111 969 filed Dec. 11, 1998

FIELD OF THE INVENTION

This device is related to hand held tape applying devices, especially to apply tape from a roll with a pressure sensitive adhesive facing out from the center of the roll.

BACKGROUND OF THE INVENTION

Previously filed applications for Masking Tape and Tape describe a different type of tapes having a pressure sensitive adhesive layer facing out from the center of a tape roll. Theses types of tapes have not existed before, hence there has not been such an applicator as described herein.

DRAWING FIGURES

DESCRIPTION OF THE INVENTION

Figure 1:
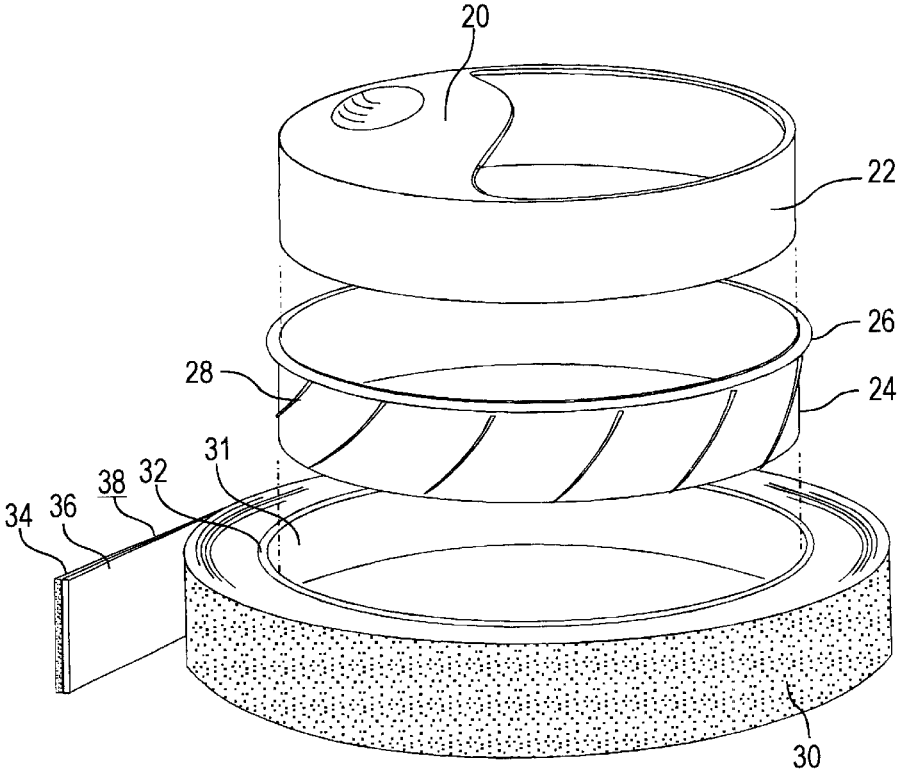
FIG. 1 shows an exploded perspective view of the tape applicator.
Figure 2:
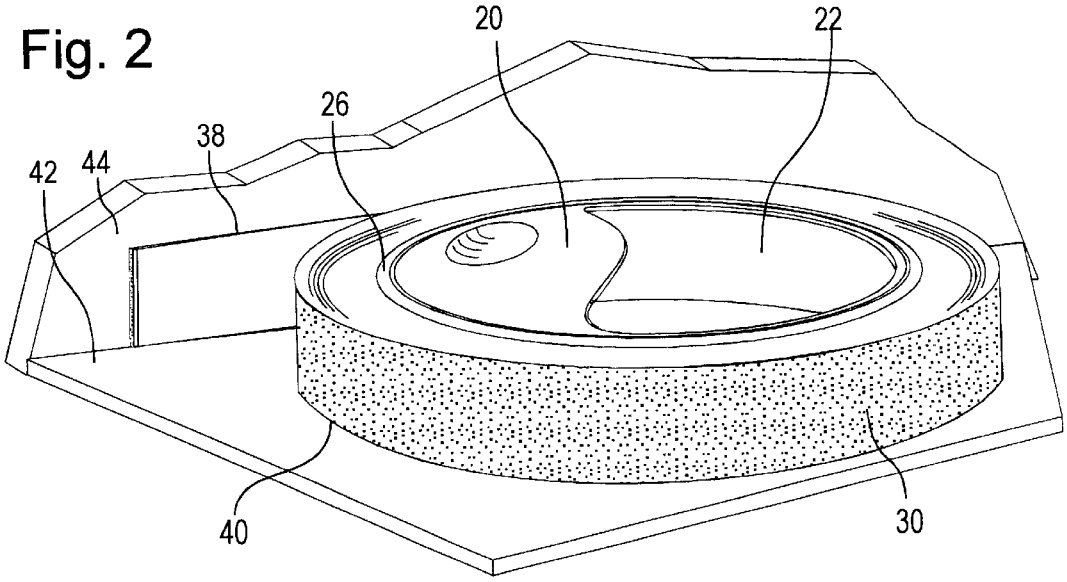
FIG. 2 shows the tape applicator secured inside of a core of a tape roll and a method to use the applicator.

The tape 38 having a backing 36 and a pressure sensitive adhesive layer 34 is wound convolutedly upon itself on a roll where the adhesive layer is facing out from the center of the roll.

The cylindrical inner core 22 of the device has a handle 20, which enables holding of the device in hand with fingers. User holds the handle 20 by placing at least a forefinger and a middle finger inside of the handle 20 and pressing the handle with a thumb against the fingers from outside. The cylindrical inner core 22 is rotably mounted inside of the cylindrical outer core 24 snapfitting inside of the outer core 24.

The outer core 24 has a plurality of screw type threads 28 on its outer rim, which tightens the device inside of the core of the tape roll 32. The device forces a pressure against the inner rim 31 of the core of the tape roll 32. The unlaminating resistance of the tape 38 when tape is pulled out of the roll causes a force which further tightens the threads 28 of the device in its place.

The device can be secured inside of the core of the tape roll also by screws through the outer core of the device against the tape core 32 or by providing the device with a tightening means on the other side of the tape roll 30 tightening the core of the tape roll 32 to the device.

A ring type stopper collar 26 extending outside of the outer core prevents the device from going too deep inside of the core of the tape roll 32.

The device is preferably made out of polymeric material by extruding it to a mold.

OPERATION OF THE INVENTION

User takes the device with the tape roll in hand by placing preferably at least a forefinger and a middle finger inside of the device behind the handle 20 and presses the handle against the fingers by a thumb.

The outside side from a user facing side 40 of the tape roll 30 is supported against a first surface 42 and the free end of the tape is fixed to a adjacent second surface 44 by the pressure sensitive adhesive 34. The tape 34 is unwound along the second surface 44 by simultaneously supporting the side of the tape against the first surface 42. The longitudinal edge of the tape 38 accurately follows the first surface 42.

The description and drawing figures of this invention describe a version with a handle where the fingers are placed inside of the applicator and the applicator is kept in hand by pressing the applicator against the fingers by a thumb. An optional thumb rests is shown on the top of the applicator. However the inner core and especially the thumb rest can be extended to be over the side of the rolled tape or on the top of outer periphery of the tape roll. This invention and method can be used to apply all kind of tapes where the pressure sensitive adhesive faces out from the center of the roll. Different types of tapes with pressure sensitive layer facing out from the center of the roll are described in provisional patent applications mentioned before.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

LIST OF REFERENCE NUMERALS

20 handle
22 inner core of the device
24 outer core of the device
26 stopper collar
28 threads
30 tape roll
31 inner rim of the roll core
32 core of the tape roll
34 pressure sensitive adhesive layer
36 backing layer
38 tape
40 side of the tape roll
42 first surface
44 second surface

I claim:

1. A tape applicator suitable for applying a tape having a pressure sensitive adhesive layer facing outside of the center of a tape roll a comprising;

a) an inner core having outer walls and a holding means suitable to keep the device in hand;
said inner core being rotably mounted inside of b) an outer core being suitable to be secured inside of the core of the tape roll.

* * * * *